US009801770B2

(12) United States Patent
Edavana et al.

(10) Patent No.: US 9,801,770 B2
(45) Date of Patent: Oct. 31, 2017

(54) METHOD AND SYSTEM FOR TILTING AN INFANT-CARE MEDICAL DEVICE

(71) Applicant: KONINKLIJKE PHILIPS N.V., Eindhoven (NL)

(72) Inventors: Roopesh Edavana, Bangalore (IN); Lakshmikantha Krishnamurthy Shirahatti, Bangalore (IN)

(73) Assignee: Koninklijke Philips N.V., Eindhoven (NL)

( * ) Notice: Subject to any disclaimer, the term of this patent is extended or adjusted under 35 U.S.C. 154(b) by 69 days.

(21) Appl. No.: 14/442,734

(22) PCT Filed: Dec. 11, 2013

(86) PCT No.: PCT/IB2013/060788

§ 371 (c)(1),
(2) Date: May 14, 2015

(87) PCT Pub. No.: WO2014/091412

PCT Pub. Date: Jun. 19, 2014

(65) Prior Publication Data

US 2015/0328074 A1 Nov. 19, 2015

Related U.S. Application Data

(60) Provisional application No. 61/735,596, filed on Dec. 11, 2012.

(51) Int. Cl.

| | |
|---|---|
| ***A61G 11/00*** | (2006.01) |
| ***A61G 13/04*** | (2006.01) |
| ***A47D 9/02*** | (2006.01) |

(52) U.S. Cl.
CPC ..... *A61G 11/008* (2013.01); *A47D 9/02* (2013.01); *A61G 11/00* (2013.01); *A61G 13/04* (2013.01); *A61G 2210/90* (2013.01)

(58) Field of Classification Search
CPC .... A61G 11/00; A61G 11/001; A61G 11/002; A61G 11/003; A61G 11/006;
(Continued)

(56) References Cited

U.S. PATENT DOCUMENTS 2,366,630 A * 1/1945 Kreiselman ..... A61G 11/00 600/22
2,633,842 A * 4/1953 Higgs ..... A61G 11/00 261/153

(Continued)

FOREIGN PATENT DOCUMENTS

EP 711537 A1 5/1996
EP 0743054 A2 11/1996

(Continued)

*Primary Examiner* — Robert G Santos
*Assistant Examiner* — David R Hare

(57) ABSTRACT

A method and system tilts an infant-care medical device. In one example, the method and system pivots the infant-care device about the tilt axis by releasing a tilt platform of the infant-care medical device using an actuator to allow the tilt platform to pivot about the tilt axis. The method and system also selectively adjusts a rotational position of the tilt platform relative to a tilt axis. As the tilt platform pivots about the tilt axis, the system and method dampens pivoting of tilt platform using a damper. As so dampened, the pivoting of the tilt platform is counter-balanced such that vibration and/or movements that may be felt by an infant within the infant-care medical device may be reduced.

10 Claims, 4 Drawing Sheets

(58) Field of Classification Search
CPC ..... A61G 11/008; A61G 7/018; A61G 7/005; A61G 13/02; A61G 13/04; A61G 2210/90; A47D 7/00; A47D 9/00; A47D 9/02; A47C 21/048
See application file for complete search history.

(56) References Cited

U.S. PATENT DOCUMENTS

| | | | | | |
|---|---|---|---|---|---|
| 2,855,921 | A * | 10/1958 | Grosholz | A47D 9/02 | 601/42 |
| 3,240,935 | A * | 3/1966 | Dougall | A61B 6/04 | 378/209 |
| 3,858,570 | A * | 1/1975 | Beld | A61G 11/008 | 392/416 |
| 4,006,499 | A * | 2/1977 | Young | A61G 7/002 | 5/608 |
| 4,628,553 | A | 12/1986 | Buttitta et al. | | |
| 4,750,474 | A * | 6/1988 | Dukhan | A61G 11/00 | 128/205.26 |
| 4,819,282 | A | 4/1989 | McArthur | | |
| 5,131,333 | A | 7/1992 | Karasawa et al. | | |
| 5,624,375 | A | 4/1997 | Dykes et al. | | |
| 5,860,899 | A * | 1/1999 | Rassman | A61H 1/0222 | 482/131 |
| 6,022,310 | A * | 2/2000 | Goldberg | A61G 11/00 | 600/22 |
| 6,071,228 | A * | 6/2000 | Speraw | A61G 11/00 | 600/22 |
| 6,082,693 | A * | 7/2000 | Benson | A61G 11/00 | 248/281.11 |
| 6,155,970 | A * | 12/2000 | Dykes | A61G 11/008 | 5/610 |
| 6,611,978 | B1 * | 9/2003 | Schmidt | A61G 11/00 | 5/603 |
| 6,659,935 | B2 * | 12/2003 | Costanzo | A61G 11/00 | 5/610 |
| 6,709,384 | B1 * | 3/2004 | Donnelly | A61F 7/00 | 600/22 |
| 6,880,188 | B1 * | 4/2005 | Schmidt | A61B 6/4283 | 177/144 |
| 6,926,663 | B2 | 8/2005 | Costanzo | | |
| 6,971,127 | B2 | 12/2005 | Richards | | |
| 8,419,610 | B2 * | 4/2013 | Matsubara | A61G 11/00 | 236/2 |
| 9,333,140 | B2 * | 5/2016 | Bharadwaj | A61G 7/005 | |

FOREIGN PATENT DOCUMENTS

| | | | | |
|---|---|---|---|---|
| EP | 968698 | A2 | 5/2000 | |
| EP | 1374741 | A1 | 2/2004 | |
| EP | 1764071 | A2 | 3/2007 | |
| WO | 0143686 | A2 | 6/2001 | |
| WO | WO 2009073444 | A1 * | 6/2009 | A61G 11/00 |
| WO | 2012110941 | A1 | 8/2012 | |

* cited by examiner

METHOD AND SYSTEM FOR TILTING AN INFANT-CARE MEDICAL DEVICE

CROSS-REFERENCE TO PRIOR APPLICATIONS

This application is the U.S. National Phase application under 35 U.S.C. §371 of International Application No. PCT/IB2013/060788, filed on Dec. 11, 2013, which claims the benefit of U.S. Provisional Patent Application No. 61/735,596, filed on Dec. 11, 2012. These applications are hereby incorporated by reference herein.

The present disclosure pertains to a method and apparatus for tilting an infant-care medical device, and, in particular for providing a smooth tilting for the infant-care medical device.

Infants are vulnerable to infections, and bacterial organisms, viral organisms, and other pathogenic organisms that can cause infections. At least in some cases, these can be transmitted through airborne transmission of ambient air containing contaminated particles. Incubators, baby warmers, infant-supporting devices, and/or infant-care medical devices for infants, e.g. neonates, can be used in intensive care environments or elsewhere, e.g. to maintain an environment with an appropriate temperature, air flow, humidity, sterile conditions, and/or other environmental conditions. Environments that commonly employ incubators and/or baby warmers, such as, e.g., hospitals, commonly are plagued by a wide range of pathogenic organisms. Some infants may, under certain conditions, benefit from being positioned at a tilted angle rather than on a flat surface. For example, head end elevation may prevent gastro esophageal reflux (GER) in preterm infants. Foot end elevation may benefit neonates having cardiac failure.

Accordingly, one or more aspects of the present disclosure relate to a system that tilts a tilt platform that tilts about a tilt axis, wherein the tilt platform is configured to support an infant-care medical device. The system comprises a support structure, a tilt platform mounted on the support structure, wherein the tilt platform configured to support an infant within the thermo-regulated area, the tilt platform being configured to pivot about a tilt axis, and an actuator coupled with the tilt platform, wherein the actuator is operable to lock the tilt platform in a rotational position relative to the tilt axis such that the tilt platform is not free to pivot about the tilt axis and unlock the tilt platform from the locked rotational position to allow the tilt platform to pivot about the tilt axis. The system also comprises a damper disposed between the tilt platform and the support structure, wherein the damper is coupled to the tilt platform and is configured to dampen pivoting of the tilt platform as the tilt platform pivots about the tilt axis.

Still another aspect of present disclosure relates to a method for tilting an infant-care medical device having a thermo-regulated area using a system having a tilt platform that tilts about a tilt axis, a support structure, an actuator, a tilt mechanism, and a damper disposed between the tilt platform and support structure. The method comprises releasing the tilt platform using the actuator to allow the tilt platform to pivot about the tilt axis; selectively adjusting a rotational position of the tilt platform relative to the tilt axis; dampening pivoting of tilt platform using the damper as the tilt platform pivots about the tilt axis; and locking the tilt platform in a selected rotational position relative to the tilt axis.

Yet another aspect of present disclosure relates to a system for tilting an infant-care medical device having a thermo-regulated area. The system comprises support means, platform means mounted on the support structure, wherein the platform means is configured to support an infant within the thermo-regulated area, the platform means being configured to pivot about a tilt axis, and actuation means coupled with the platform means, wherein the actuation means is configured to lock the platform means in a rotational position relative to the tilt axis such that the platform means is not free to pivot about the tilt axis and unlock the platform means from the locked rotational position to allow the platform means to pivot about the tilt axis. The system also comprises a damping means disposed between the platform means and the support means, wherein the damping means is coupled to the platform means and is configured to dampen pivoting of the tilt platform as the platform means pivots about the tilt axis.

These and other objects, features, and characteristics of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

The embodiments will be more readily understood in view of the following description when accompanied by the below figures and wherein like reference numerals represent like elements, wherein.

Figure 1:
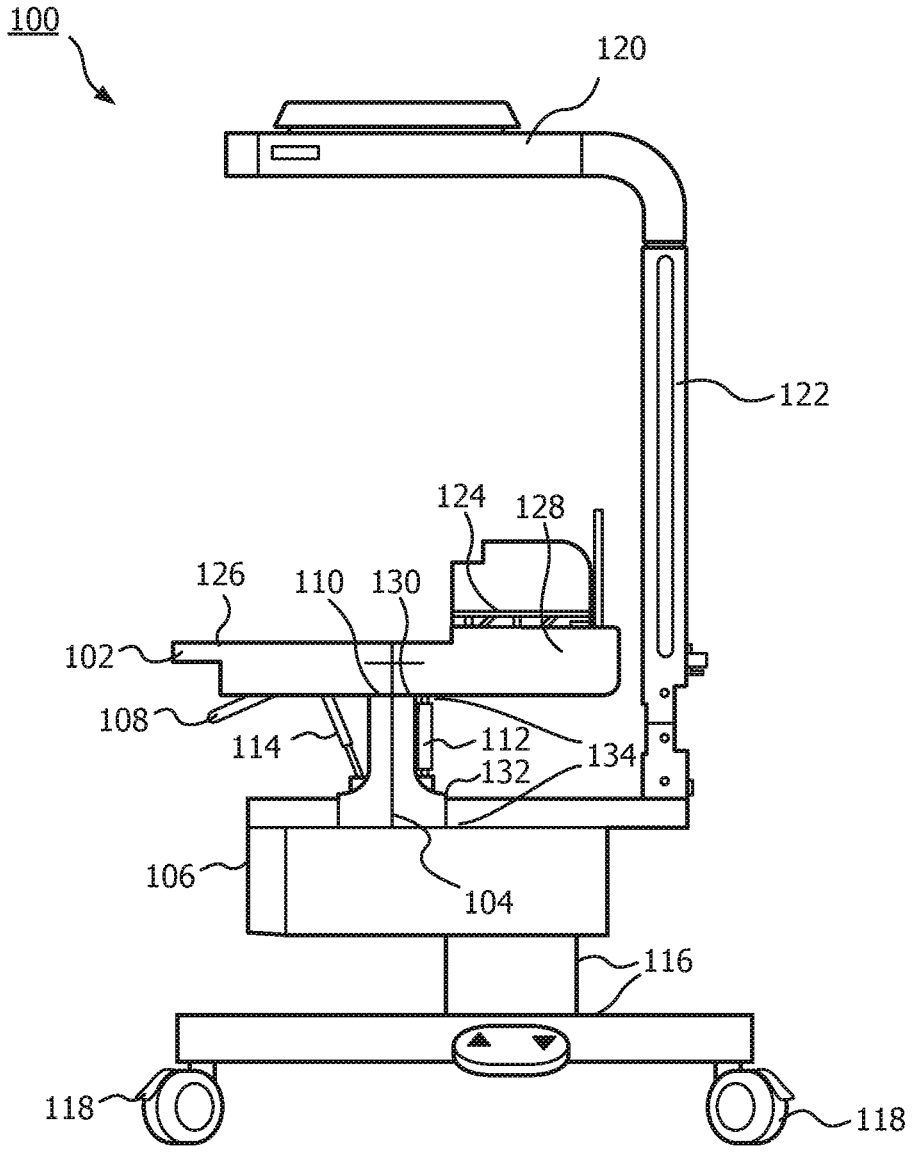
FIG. 1 is a diagram illustrating one example of a system for tilting an infant-care medical device.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

FIG. 1 illustrates one example of a system 100 for tilting an infant-care medical device, e.g., such as a warmer 120 as shown. In this example, warmer 120 may comprise a frame 122, a bed 124, a base 116 having wheels 118. As shown in this example, bed 124 may be disposed on top of a tilt platform 102 of system 100. As shown, tilt platform 102 may pivot about a tilt axis 104. System 100 may also include a support structure 106 disposed on top of the base, a first support 132 disposed between support structure 106 and tilt platform 102 having one end 130 rotatably coupled to tilt platform 102 at a pivot 110, an actuator 108 mounted to tilt platform on a first side 126 of tilt platform 102, and a damper 114, as shown in this example. As also shown, system 100 may also include a second support 112 mounted to tilt platform 102 on a second side 128 of tilt platform 102, opposite of first side 126. One of ordinary skill in the art will recognize that system 100 may also include any other suitable structure.

As shown in this example, tilt platform 102, together with support structure 106 and base 116, may be configured to support an infant within bed 124 having a thermo-regulated area provided by warmer 120. In some embodiments in accordance with the disclosure, tilt platform 102 may form an integral part of the infant-care device, such as a bottom of bed 124. In some other embodiments in accordance with the disclosure, tilt platform 102 may form a platform structure separate from the infant-care device, e.g., a tiltable base that supports bed 124 shown. As also shown in this example, tilt platform 102 may be further configured to tilt about tilt axis 104 at pivot 110.

As shown in this example, a tilt mechanism 134 may provide a pivot 110 to facilitate pivoting of tilt platform 102. As also shown, tilt mechanism 134 may comprise first support 132, disposed between tilt platform 102 and support structure 106. First support may have one end, e.g., 130, rotatably coupled to the tilt platform and is configured to facilitate pivoting of the tilt platform about the tilt axis. In this example, first support 132 is mounted to the tilt platform 102 at pivot 110 as shown such that tilt platform 102 may freely pivot about tilt axis 104 in either clockwise or counter-clockwise rotational direction.

Still shown in this example is actuator 108 disposed on first side 126 of tilt platform 102. In this example, actuator 108 is operable to lock tilt platform 102 to a rotational position relative to tilt axis 104 such that tilt platform 102 is not free to pivot about tilt axis 104 in a locked position. For example, a user of system 100, e.g., a nurse, may lock tilt platform 102 to a rotational position through actuator 108 to facilitate care for an infant placed on the bed 124 supported by tilt platform 102. Actuator 108 may also be configured to unlock tilt platform 102 from the locked rotational position to allow tilt platform 102 to pivot about the tilt axis. Further details about actuator 108 and its operations are described in FIGS. 3-5.

In this example, a damper 114 may be disposed between support structure 106 and tilt platform 102. As shown, damper 114 may be coupled to tilt platform 102 on first side 126, i.e. the same side as actuator 108. To facilitate a smooth tilting of the infant-care medical device, Damper 114 may be configured to dampen pivoting of tilt platform 102 as tilt platform 102 pivots about tilt axis 104. In some embodiments in accordance with the disclosure, damper 114 may be an extension device operable to apply a bias in a rotational direction to oppose the rotational force that pivots tilt platform 102. For instance, in a use case where the user rotates tilt platform 102 with a second side 128 of tilt platform 102 (i.e., the side opposite of first side of 126) raised and first side 126 lowered, damper 114 may dampen a portion of the rotational force as tilt platform 102 pivots about tilt axis 104. As a result, damper 114 may compress as first side 126 of tilt platform 102 is lowered. Conversely, in the case where the user rotates tilt platform 102 with the second side 128 lowered and first side 126 raised, damper 114 may provide energy stored in the damper 114 to facilitate the tilting of tilt platform 102 about tilt axis 104.

As also shown in this example, a second support 112 may also be mounted to tilt platform 102 on second side 128 of tilt platform 102. Second support 112 may be operable to move upwardly and downwardly to facilitate pivoting of tilt platform 102. In some examples, second support 112 may apply a bias to tilt platform 102 in a rotational directional to facilitate pivoting of tilt platform 102. For instance, a user of system 100 may rotate tilt platform 102 by pushing actuator 108 downwards such that tilt platform 102 pivots about tilt axis 104 with second side 128 being raised and first side 126 being lowered. In that case, in response to the actuation force applied by the user, second support 112 may extend to raise second side 128 of tilt platform 102. In another use case, a user of system 100 may rotate tilt platform 102 by lifting actuator 108 such that tilt platform 102 pivots about tilt axis 104 with second side 128 being lowered and first side 126 being raised. In that case, in response to the user actuation force, second support 112 may move downwardly so that second side 128 of tilt platform 102 may be lowered. In either case, second support 112 may also be configured such that it may be locked in an extended or compressed position, e.g., through a control mechanism connected to actuator 108, such that tilt platform 102 is locked in a desired rotational position. Such a control mechanism is further described in FIGS. 3-5.

As described above, second support 112 and damper 114 work in tandem providing a smooth tilting for an infant-care medical device. Particularly, the damping force provided by damper 114 serves as counter-balancing to the rotational force that pivots tilt platform 102 about tilt axis 104. In some embodiments in accordance with the disclosure, damper 114 may be non-lockable such that it extends and compresses freely to achieve the damping. Through damping in accordance with the disclosure, movements associated with tilting mechanism for infant-care medical device may be damped. It is understood that although in this example second support 112 is mounted to second side 128 of tilt platform 102 and damper 114 is mounted to first side 126, in some other examples, second support 112 may be mounted to first side 126 and damper 114 may be mounted to second side 128 of tilt platform 102.

In some embodiments in accordance with the disclosure, to provide smooth extension and compression, second support 112 and damper 114 may comprise substance that generates biases when the substance is decompressed and compressed. Such substance may include, but not limited to, pneumatic agents such as gases that provide releasing and storing of energy when the substance is decompressed and compressed. For instance, second support 112 and damper 114 may be gas springs that releases energy when decompressed (e.g. extending) and stores energy when compressed.

Figure 2:
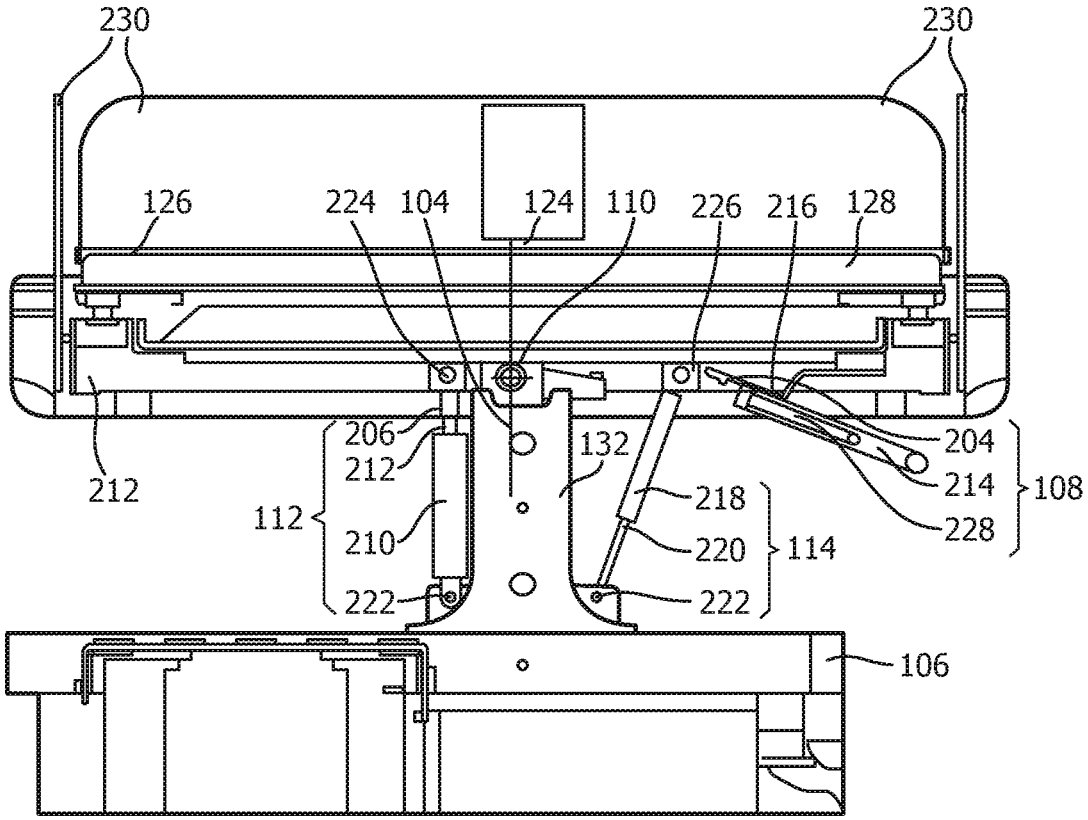
FIG. 2 is a diagram illustrating another example of a system for tilting an infant-care medical device.

FIG. 2 illustrates another example of a system 100 for tilting an infant-care medical device. It will be described with reference to FIG. 1. As shown in this example, actuator 108 may be rigidly mounted on tilt platform 102 at a second pivot 216 of system 100 on second side of tilt platform 102, i.e. second side 128 as shown in FIG. 1. As shown in this example, actuator 108 may include an actuating handle 214 that facilitates user to rotate tilt platform 102 about tilt axis 104, a link member 204, and a lever 228. As also shown, actuator 108 may pivot at second pivot 216 to allow a actuation force that rotates tilt platform 104 to be applied, for example, by a user through actuating handle 214. Further details about actuator 108 are described in FIG. 3.

As still shown in this example, second support 112 may be disposed on first side 126 of tilt platform 102, which is tiltable about tilt axis 104 at pivot 110. In this example, second support 112 may comprise, a control valve 206, casing 210 and piston rod 212. As shown, second support 112 may be mounted to support structure 106 using one or more couples 222. Second support 112 may also be connected to tilt platform 102 at a third pivot 224 of system 100. At third pivot 224, second support 112 may allow tilt platform to pivot in the same rotational direction as tilt platform 102 pivots about tilt axis at pivot 110 provided by first support 132.

Still shown in this example is a damper 114 mounted to first side 126 of tilt platform 102 at a fourth pivot 226 of system 100. As in this example, damper 114 may also be mounted to support structure 106 by one or more couples 222. Similar to second support 112, damper 114 may also include a casing 218, and a piston rod 208. At fourth pivot 226, damper 114 may also facilitate tilt platform 102 to tilt to a rotational position.

In this example, actuator 108 may be configured to control second support 112 through link member 204. In the case where a user applies a rotational force to actuator 108 to rotate tilt platform 102, second support 112 may move upwardly or downwardly to facilitate the rotating. A user may apply an actuation force to actuator 108 to release control valve 206 of second support 112 to release tilt platform 102 from a locked rotational position. In some examples, second support 112 may be a gas spring. In those examples, as control valve 206 is released, gases contained in a chamber of second support 112 may flow to another and result in a decrease of density of gas within the chamber. This further result in a release of energy stored in second support 112 and thereby allows piston rod 212 to extend to heighten tilt platform 102.

As first side 126 of tilt platform 102 is heightened by second support 112, damper 114 may be configured to dampen the energy released by second support. Like second support 112, damper 114 may also be a gas spring in some examples. In those examples, as damper 114 freely extends and compresses, the pivoting of tilt platform 102 may cause the damper 114 to depress. The depressing of damper 114 may then compress gases within damper 114 to increase the density of the gases. As a result, the compressed gases within gas spring 114 stores a portion of the energy released by second support 112 and actuation force applied by the user. In so compressing and storing, damper 114 may effectively provide a counter-balancing to the release of energy done by second support 112. Such counter-balancing helps dampen movements of tilt platform 102 as tilt platform 102 tilts about tilt axis 104.

Conversely, the first side 126 of tilt platform 102 may be lowered when a user applies an actuation force to depress control valve 206 such that second support 112 moves downwardly. In this case, the compression of second support 112 allows first side 128 of tilt platform 102 to be lowered. As the first side 126 is lowered and the second side 128 heightened in this case, damper 114 is extended as its control valve 208 is allowed to be released and thereby help the user exert a force to depress control valve 206.

Figure 3:
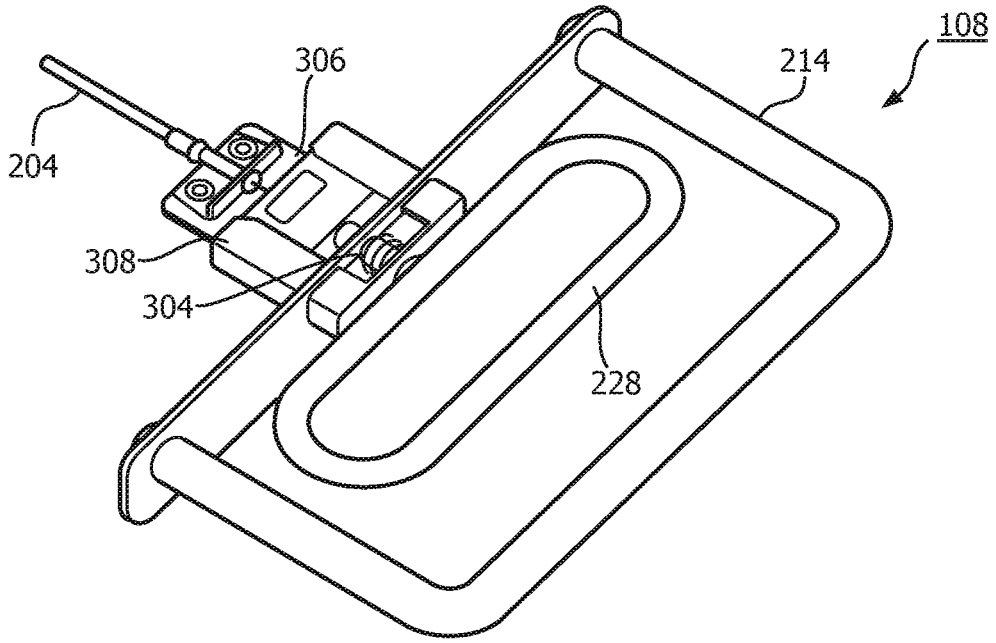
FIG. 3 is a diagram illustrating one example of an actuator as shown in FIG. 1 and FIG. 2.

FIG. 3 is a diagram illustrating one example of an actuator 108 as shown in FIGS. 1 and 2. It will be described with references to FIGS. 1-2. As shown in this example, actuator 108 may include an actuating handle 214, a lever 228, a slide block 306, a link member 204 and a spring 304 disposed inside a spring chamber 308. One of ordinary skill in the art will recognize actuator 108 may include any other suitable structure to effect actuating and controlling an infant-care medical device in accordance with the disclosure.

As shown in this example, actuating handle 224 may be configured to allow an actuation force to be applied to facilitate pivoting of tilt platform 102. For instance, in the case where the user desires to release control valve 206 of second support 112 to extend second support 112 so the tilt platform 102 may pivot about tilt axis 104, the user may apply a grip to actuating handle 214 and apply an actuation movement (e.g., pushing actuator 108 downwards for a rotational degree). As a result, actuating handle 204 allows a user to adjust rotational position of tilt platform 102 relative to tilt axis 104.

In this example, lever 228, as shown, may also be operatively connected to a link member 204, such as but not limited to a Bowden cable. As also shown, lever 228 may be configured to unlock second support 112. To achieve this, lever 228, for example, may be configured to move parallel to actuating handle 214 such that pulling 228 away from slide block 306 also pulls member link 204 in the same direction and thereby moves control valve 206 of second support 112 from a closed position to a release position (i.e. releasing control valve 206) as shown in FIG. 2. In this example, lever 228 may also be configured to lock second support 112. To achieve this, lever 228, for example as shown, may be configured such that releasing lever 228 from an away position relative to slide block 306 also releases member link 204 in the same direction and thereby returns control valve 206 of second support 112 from the position to a closes position (i.e. depressing control valve 206) as shown in FIG. 2.

In this example, slide block 306 may include a spring mechanism that helps move lever 228. In this example, slide block 306 comprises a spring 304, which moves inside spring chamber 308 and may form an integral part of actuator 108. Spring chamber 308 may be configured to restrain extension of spring 304 such that spring 304 may not extend outside of spring chamber 308. In this example, spring 304 may be configured to be connected to lever 228 and allows lever 228 to be released and closed as described above. As so configured, spring 304 may help overcome some friction caused by sliding of member link 204, such as a Bowden cable, connected to lever 228.

Figure 4:
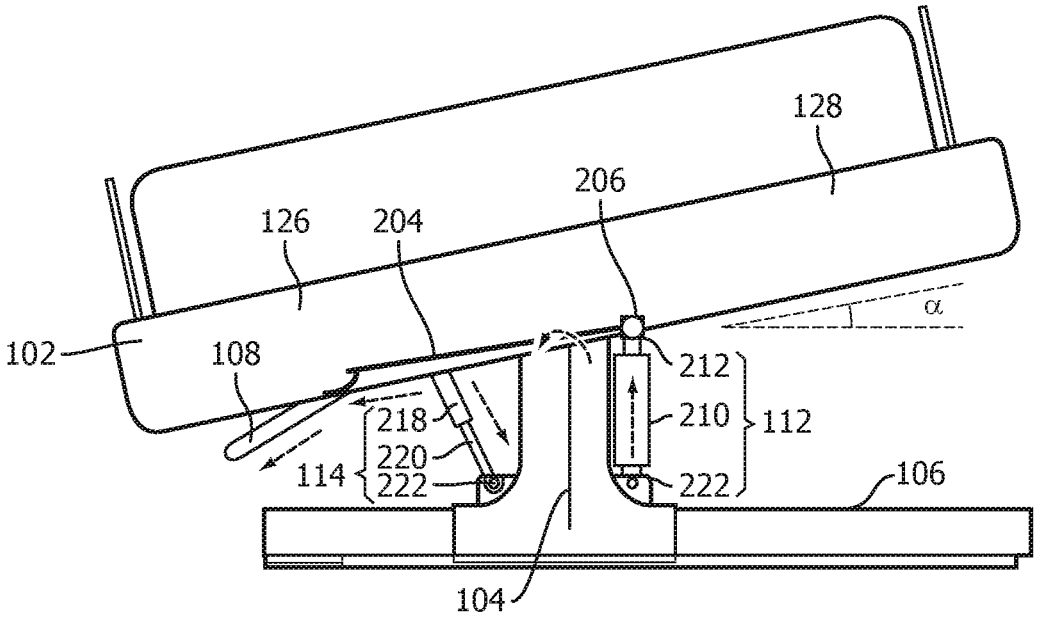
FIG. 4-5 illustrates two examples of tilting an infant care medical device in accordance with the disclosure.

FIG. 4 is a diagram illustrating one example to tilt an infant-care medical device in accordance with the disclosure. It will be described with references to FIGS. 1-3. As shown, a user may use a system 100 to tilt an infant-care medical device to a $\alpha$ degree relative to tilt axis 104. To achieve this, the user may first release and hold lever 228 of actuator 108 to pull member link 204. As member link 204 is connected to control valve 206 of second support 112, the pulling of control valve 206 unlocks second support 112 as described in FIG. 2 to allow second support 112 to freely move upwardly and downwardly. To rotate tilt platform 102 to $\alpha$ degree position, while holding lever 228, the user may apply an actuation force (e.g. pulling downwards) to actuating handle 214 until infant-care tilt platform 102 reaches that position.

During the pivoting of tilt platform 102 about the tilt axis 104, second support 112 and damper 114 work in tandem to dampen and reduce the rotational force and movements applied by the user. In this example, as tilt platform 102 pivots about tilt axis 104 counter clockwise, second support 114 moves upwardly since it is unlocked by the pulling force applied by the user through actuator 108 via member link 204. At the same time, damper 114 may compresses as shown to dampen a portion of rotational force that pivots tilt platform 102. Once tilt platform reaches α degree position, the user may release lever 228 to lock second support 112 such that second support 112 is not free to move upwardly or downwardly.

Figure 5:
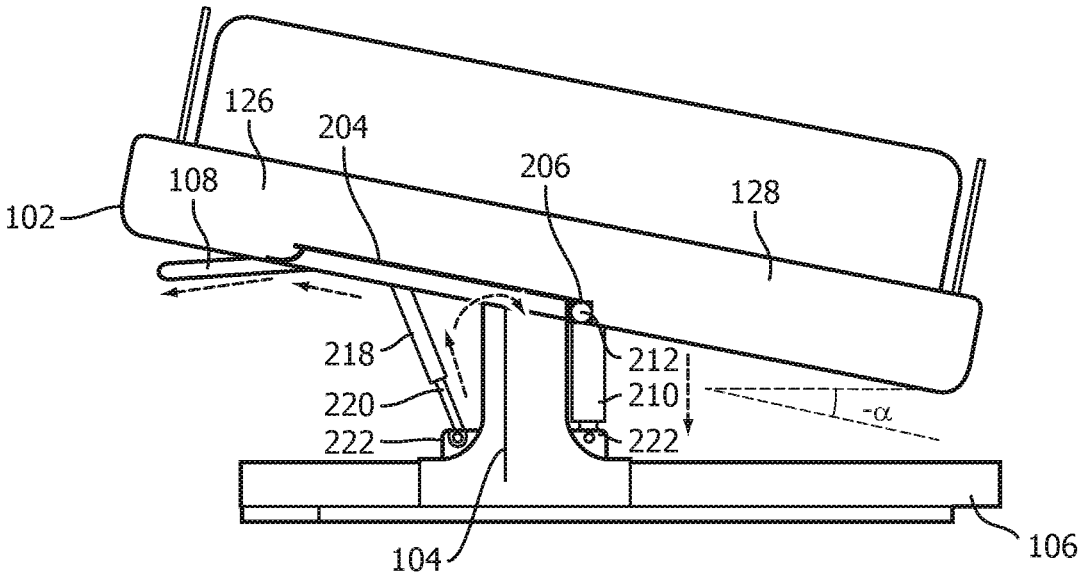

FIG. 5 is a diagram illustrating another example to tilt an infant-care medical device in accordance with the disclosure. It will be described with references to FIGS. 1-3. A user may tilt an infant-care medical device to a −α degree relative to tilt axis 104, as shown in FIG. 5. To achieve this, the user may first release and hold lever 228 of actuator 108 to pull member link 204. As member link 204 is connected to control valve 206 of second support 112, the pulling of control valve 206 unlocks second support 112 as described in FIG. 2 to allow second support 112 to freely move downwardly and upwardly. To rotate tilt platform 102 to −α degree position, while holding lever 228, the user may apply an actuation force (e.g. lifting upwards) to actuating handle 214 until tilt platform 102 reaches that position.

During the pivoting of tilt platform 102 about the tilt axis 104, second support 112 and damper 114 work in tandem as described above. In this example, as tilt platform 102 pivots about tilt axis 104 clockwise, second support 112 moves downwardly since it is unlocked by the pulling force applied by the user through actuator 108 via member link 204. At the same time, damper 114 may extend as shown to help apply a portion of rotational force that pivots tilt platform 102. Once tilt platform reaches −α degree position, the user may release lever 228 to lock second support 112 such that second support 112 is not free to move upwardly or downwardly.

Figure 6:
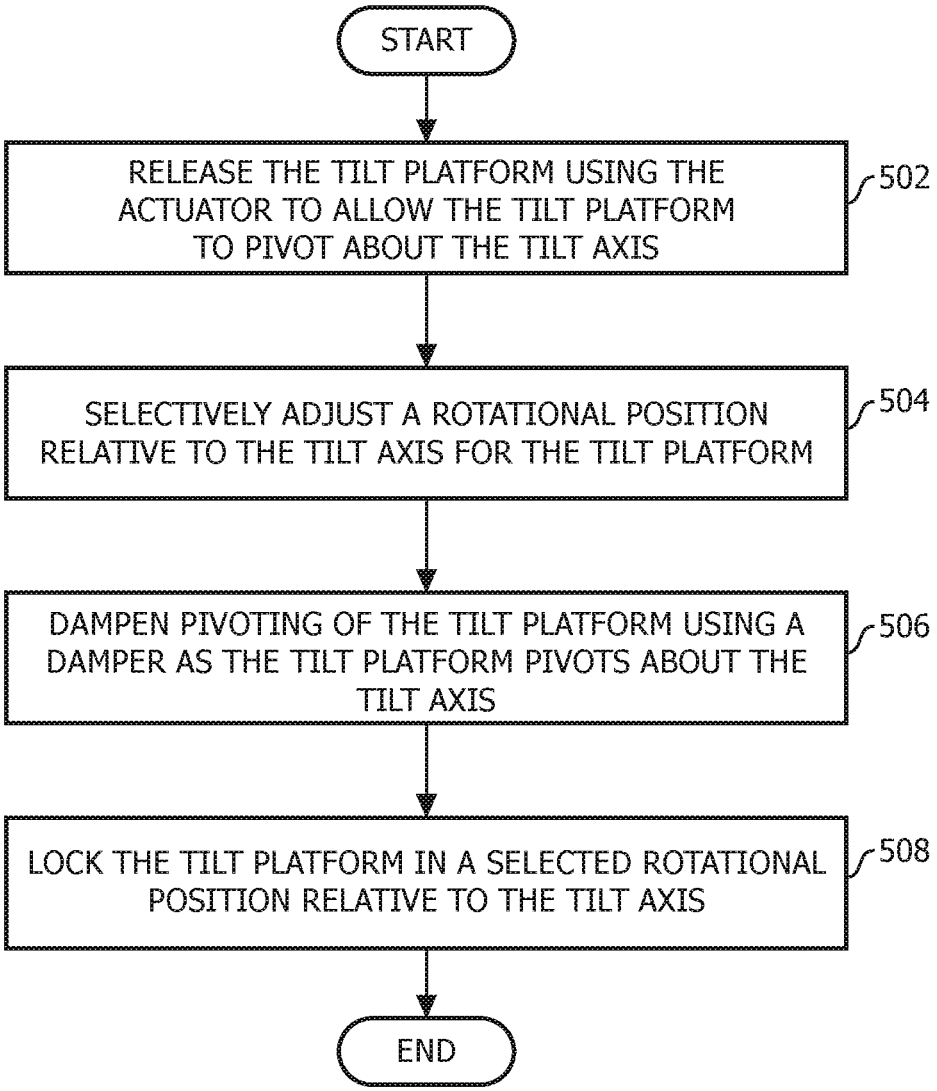
FIG. 6 is a flow chart illustrating one example of tilting a system for tilting an infant-care medical device.

FIG. 6 is a flow chart illustrating one example of tilting an infant-care medical device in accordance with the disclosure. It will be described with references to FIGS. 1-3. In operation, at block 502, a user may release tilt platform 102 using actuator 108 to allow the tilt platform 102 to pivot about the tilt axis 104. As described above, Actuator 108 may include a lever 228 that allows the user to unlock tilt platform 102 from the rotational position relative to tilt axis 104 by, for example, pulling lever 228 parallel towards actuating handle 214. Lever 228 may be connected to a control mechanism such as member link 204. The control mechanism may be connected to tilt mechanism 134 at the other end opposite the end connecting to lever 228 to achieve locking and unlocking the tilt platform as described above.

At block 504, in operation, the user may selectively adjust a rotational position of tilt platform 102 relative to tilt axis 104. In some embodiments, a user may apply an actuation force to actuator 108 to rotate tilt platform 102. For instance, the user may push actuator 108 downwards while holding actuating handle 214 as described above.

At block 506, in operation, in response to the actuation force applied by the user to pivot tilt platform 102, damper 114 may dampen pivoting of tilt platform 102 as tilt platform 102 pivots about tilt axis 104. In some examples, damper 114 may be a non-lockable gas spring that extends or compresses freely as tilt platform 102 pivots about tilt axis 104. As described above, damper 114 may provide a counter-balancing to tilt platform 102 to facilitate smooth tilting of tilt platform 102.

At block 508, in operation the user may lock tilt platform 102 in a selected rotational position relative to the tilt axis. For example, the user may release lever 228 of actuator 108 as tilt platform reaches a desired rotational position. The release of lever 228 may release a control mechanism such as member link 204 that is connected to tilt mechanism 134. The release of member link 204 in turn allows tilt platform 102 to be locked as described above.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

Although the description provided above provides detail for the purpose of illustration based on what is currently considered to be the most practical and preferred embodiments, it is to be understood that such detail is solely for that purpose and that the disclosure is not limited to the expressly disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

The invention claimed is:

1. A system for tilting an infant-care medical device having a thermo-regulated area, the system comprising:

a support structure;

a tilt platform mounted on the support structure, the tilt platform configured to support an infant within the thermo-regulated area, the tilt platform being configured to pivot about a tilt axis;

a tilt mechanism arranged to selectively adjust a rotational position of the tilt platform relative to the tilt axis, wherein:

the tilt mechanism is disposed between the tilt platform and the support structure, extends away from the support structure, and remains in a fixed position relative to the support structure;

the tilt axis remains in a fixed position relative to the support structure; and the tilt mechanism disposed on a first side of the tilt axis and configured to drive pivotal movement of tilt platform relative to the tilt axis;

an actuator coupled with the tilt mechanism, wherein the actuator is operable to operate the tilt mechanism to:

lock the tilt platform in a rotational position relative to the tilt axis such that the tilt platform is not free to pivot about the tilt axis; and unlock the tilt platform from the locked rotational position to allow the tilt platform to pivot about the tilt axis; and a damper disposed between the tilt platform and the support structure, the damper being positioned on a second side of the tilt axis, opposite to the first side, wherein the damper is coupled to the tilt platform and is configured to dampen pivoting of the tilt platform as the tilt platform pivots about the tilt axis.

2. The system of claim 1, wherein the tilt mechanism comprises a first support disposed between the tilt platform and the support structure, wherein the first support has one end rotatably coupled to the tilt platform at a pivot and is configured to facilitate pivoting of the tilt platform about the tilt axis.

3. The system of claim 1, wherein the tilt mechanism comprises a second support with stored energy, and wherein operation of the actuator releases the stored energy to move the tilt platform.

4. The system of claim 1, wherein the second support comprises a cylinder, and wherein the actuator is operatively connected to the cylinder via a valve, and wherein the actuator is configured to operate the valve.

5. The system of claim 4, wherein the actuator comprises a link member and a lever connected to the link member, the link member connected to the tilt mechanism, and wherein operation of the lever operates the tilt mechanism through the link member.

6. A system for tilting an infant-care medical device having a thermo-regulated area; the system comprising:

support means;

platform means mounted on the support means, the platform means configured to support an infant within the thermo-regulated area, the platform means being configured to pivot about a tilt axis;

tilt means configured to selectively adjust a rotational position of the platform means relative to the tilt axis, wherein the tilt means is disposed between the platform means and the support means, extends away from the support means, and remains in a fixed position relative to the support means;

the tilt axis remains in a fixed position relative to the support means; and the tilt means disposed on a first side of the tilt axis and configured to drive pivotal movement of platform means relative to the tilt axis;

actuation means coupled with the platform means, wherein the actuation means is configured to:

lock the platform means in a rotational position relative to the tilt axis such that the platform means is not free to pivot about the tilt axis; and unlock the platform means from the locked rotational position to allow the platform means to pivot about the tilt axis; and damping means disposed between the platform means and the support means, the dampening means being positioned on a second side of the tilt axis, opposite to the first side, wherein the damping means is coupled to the platform means and is configured to dampen pivoting of the platform means as the platform means pivots about the tilt axis.

7. The system of claim 6, wherein the tilt means comprises a first support means disposed between the platform means and the support means, wherein the first support means has one end rotatably coupled to the platform means at a pivot and is configured to facilitate pivoting of platform means about the tilt axis.

8. The system of claim 7, wherein the tilt means comprises a second support means with stored energy, and wherein operation of the actuation means releases the stored energy to move the platform means.

9. The system of claim 8, wherein the second support means comprises a cylinder and wherein the actuation means is operatively connected to the cylinder via a valve, and wherein the actuation means is configured to operate the valve.

10. The system of claim 9, wherein the actuation means comprises a link member and a lever connected to the link member, the link member connected to the tilt means, and wherein operation of the lever operates the tilt means through the link member.

* * * * *